US005875511A

United States Patent [19]

Nejdl

[11] Patent Number: 5,875,511

[45] Date of Patent: Mar. 2, 1999

[54] DISPOSABLE HEAD BATH AND BACK BRUSH

[75] Inventor: Benjamin J. Nejdl, Palatine, Ill.

[73] Assignee: Safe-Lite, Inc., Palatine, Ill.

[21] Appl. No.: 915,165

[22] Filed: Aug. 20, 1997

[51] Int. Cl.[6] ..... A47K 7/02; A46B 15/00; A47L 13/16

[52] U.S. Cl. ..... 15/176.1; 15/176.6; 15/244.1; 206/461; 206/495

[58] Field of Search ..... 15/176.1–176.6, 15/209.1, 210.1, 244.1; 206/461, 495

[56] References Cited

U.S. PATENT DOCUMENTS

| | | | |
|---|---|---|---|
| 2,701,380 | 2/1955 | Ripper | 15/176.3 X |
| 3,629,894 | 12/1971 | Stefany | 15/176.3 X |
| 3,862,462 | 1/1975 | Reiter | 15/182 |
| 4,062,083 | 12/1977 | Mckay | 15/106 |
| 4,127,911 | 12/1978 | Cupp et al. | 15/210.1 |
| 4,155,140 | 5/1979 | Janssen et al. | 15/210.1 |
| 4,399,582 | 8/1983 | Ernest | 15/176.4 |
| 4,531,636 | 7/1985 | Salacuse | 206/461 |
| 4,811,445 | 3/1989 | Lagieski et al. | 15/104.94 |
| 4,831,678 | 5/1989 | Dietsche | 15/176.4 |
| 4,943,018 | 7/1990 | Glaser et al. | 248/110 |
| 5,218,733 | 6/1993 | Leu | 15/146 |
| 5,323,506 | 6/1994 | Babitch | 15/244.1 X |
| 5,609,255 | 3/1997 | Nichols | 15/244.3 X |
| 5,617,884 | 4/1997 | Allison | 132/310 |

FOREIGN PATENT DOCUMENTS

| | | | |
|---|---|---|---|
| 2635050 | 2/1990 | France | 15/210.1 |

*Primary Examiner*—Mark Spisich

[57] ABSTRACT

The invention comprises a disposable brush for scrubbing a human torso, including the back, while bathing. The brush comprises a handle having a hook at a first end, a receptacle at a second end and an elongated hand hold connecting the hook and the receptacle. The receptacle has a proximal end, a distal end, a central web having a first side and a second side and a pair of laterally spaced convex curved sidewalls connecting the first and second sides. The curved sidewalls terminate in a first head stop adjacent to proximal end. The central web has a head retaining tang protruding from the first side adjacent to distal end. The head comprises a scrubbing portion and a backing portion. The backing portion has a pair of laterally spaced internally concave curved depending wings and a connecting plate. The wings and connecting plate are adapted to slide over the handle central web and curved sidewalls and be retained by and between the stops and the tang.

12 Claims, 2 Drawing Sheets

DISPOSABLE HEAD BATH AND BACK BRUSH

FIELD OF THE INVENTION

The invention relates to long handled brushes for scrubbing one's back, especially such brushes having disposable and replaceable heads.

BACKGROUND OF THE INVENTION

It is quite common for a household to have a long handled brush in or about its shower or bath for use in scrubbing the houseowner's back. However, it is uncommon to find a back brush in a bathing area used by numerous unrelated persons, such as in a hotel or nursing home, due to concerns relating to the maintenance of the sanitary cleanliness of the brush, especially the bristles or sponge head of the brush. Such concern over the sanitary nature of brushes occurs because the entire brush, including the handle, is generally unitary with the brush or sponge head, and there is no efficient method of being able to make the brush sanitary between uses.

The instant invention solves this problem elegantly and effectively by separating the handle portion from the head portion and making the head portion easily removable from and replaceable on the handle with a simple sliding motion. The head is also simply designed so as to be inexpensively produced so that it can be disposed of between uses.

Disposable head brushes have been used in other areas, such as in toothbrushes. For example, a disposable head toothbrush is disclosed in U.S. Pat. No. 4,811,445. However, this toothbrush would not be adaptable to a back brush because the head is very elaborate and expensive to produce and the attaching mechanism between the handle and the head would be difficult for an individual to operate in the larger scale of a back brush.

It is also known to attach a back brush to a wall by suction cups as in U.S. Pat. No. 4,943,018. The bristles of this brush are obviously not disposable for use by various unrelated persons.

SUMMARY OF THE INVENTION

The invention comprises a disposable brush for scrubbing a human torso, including the back, while bathing. The brush comprises a handle having a hook at a first end, a receptacle at a second end and an elongated hand-hold connecting the hook and the receptacle. The receptacle has a proximal end, a distal end, a central web having a first side and a second side and a pair of laterally spaced convex curved sidewalls connecting the first and second sides. The curved sidewalls terminate in a first head stop adjacent to proximal end. The central web has a head retaining tang protruding from the first side adjacent to distal end. The head comprises a scrubbing portion and a backing portion. The backing portion has a pair of laterally spaced internally concave curved depending wings and a connecting plate. The wings and connecting plate are adapted to slide over the handle central web and curved sidewalls and be retained by and between the stops and the tang.

In one embodiment, the hand-hold has roughened surfaces adjacent to the first end and the second end to aid in gripping of the hand-hold by the human hand.

In various embodiments, the scrubbing portion can comprise a sponge or a brush or other suitable means for scrubbing human skin.

In one embodiment, the brush handle hook has an inner diameter of approximately one and a quarter inches so that it can be hung from the shower head pipe or the shower curtain rod.

In one preferred embodiment, one side of the receptacle central web is substantially flat and at least partially comprises an area for placing printed information, such as advertising or instructional material on how to use the brush.

In another preferred embodiment, the invention also comprises a display card for holding the handle and the head separately before use.

The invention also comprises a disposable scrubbing head for use in combination with a handle receptacle. The receptacle has a proximal end, a distal end and a central web having a first side, a pair of laterally spaced convex curved sidewalls, with the sidewalls terminating in a first head stop and the central web first side having a head retaining tang protruding therefrom adjacent the distal end. The head comprises a sponge portion having a first side and a second side, and a backing portion having a central connecting plate, also having a first side and a second side. The first side of the sponge portion and the first side of the backing portion are bonded. The backing portion second side comprises means for attaching the head to the handle. The attaching means comprises a pair of laterally spaced internally concave curved wings extending from two opposite lateral sides of the connecting plate and curving away from the first side. By this construction, the head can be slid over the handle receptacle with the wings wrapped around the handle curved sidewalls and the central connecting plate riding up and over the tang until the head is fully installed and wherein the head is retained between the stops and tang on either end of the central connecting plate.

The invention also comprises, in combination, a disposable scrubbing head and a handle. The handle comprises a hook at a first end and a receptacle at a second end. The receptacle has a proximal end and a distal end, a central web having a first side and a second side and a pair of laterally spaced convex curved sidewalls connecting the first and second sides and a central web having a tang extending from the first side adjacent the distal end. The curved sidewalls have head stops adjacent the proximal end of the receptacle. An elongated hand-hold is disposed between the hook and the receptacle. The hand-hold has roughened surfaces adjacent the first and second ends to aid in gripping thereof by a human hand. The scrubbing head comprises a sponge portion having a first side and a second side and a backing portion having a central connecting plate also having a first side and a second side. The first side of the sponge portion and the first side of the connecting plate are adhesively bonded. The backing portion central plate also has concave sidewings extending away from the first side along two opposite sides of the connecting plate. By this construction, the head can be releasably attached to the handle by sliding the head over the receptacle with the sidewings wrapped around the convex curved receptacle sidewalls and the central connecting plate riding up and over the tang until the head is fully installed and wherein the head is retained on the receptacle by and between the stops and tang on two opposite ends of the central connecting plate brush.

In one embodiment, the receptacle further comprises a pair of slots adjacent the curved side walls on the first side and the head curved sidewings have ends and the sidewing ends rest in the slots when the head is mounted on the handle.

Figures 1, 2, 3, 4, 5:
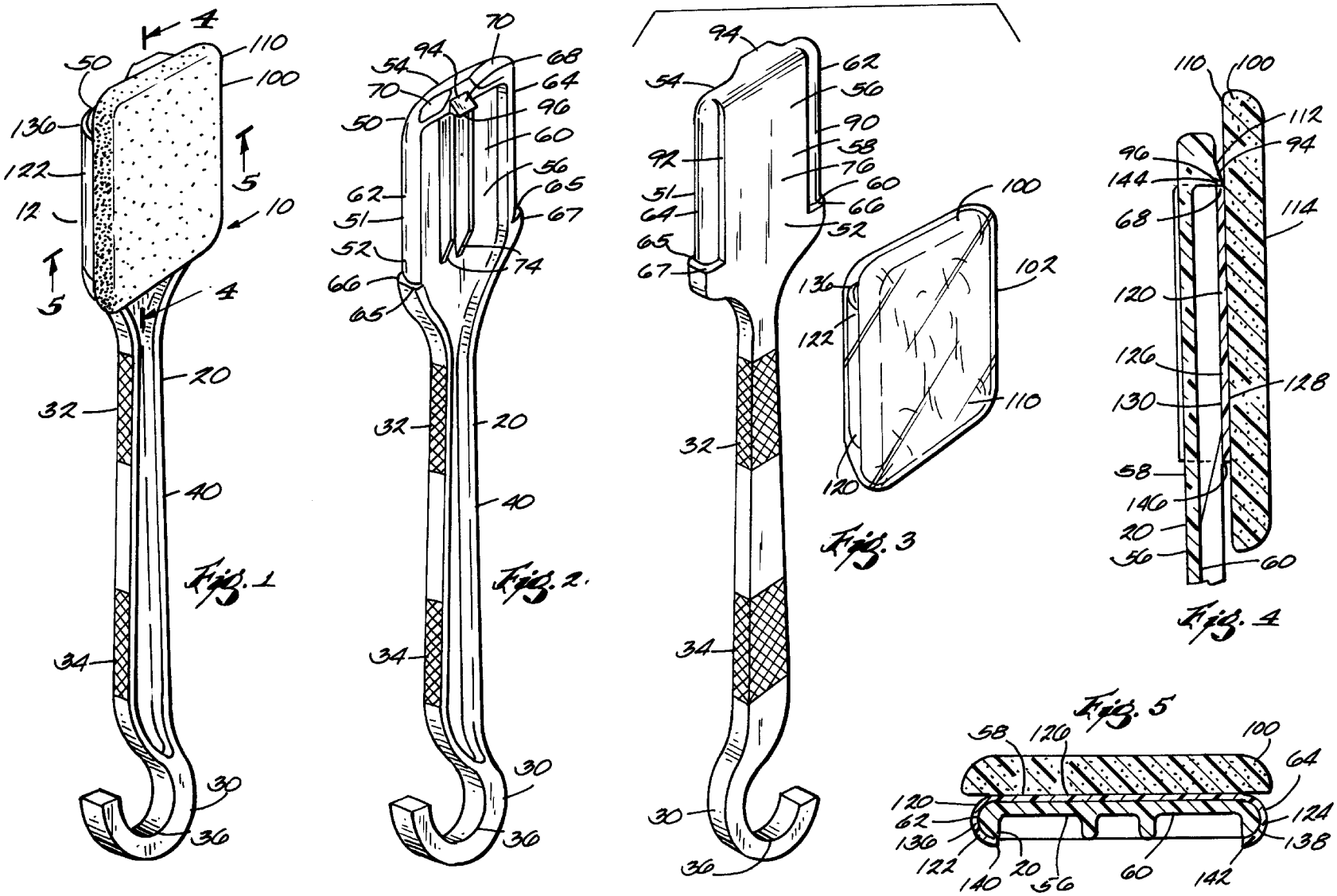
FIG. 1 is a perspective view of the bottom or second side of the brush with the head attached to the handle.
FIG. 2 is a perspective view of the bottom or second side of the handle.
FIG. 3 is a perspective view of the top or first side of the handle and the top side of the head while the head is wrapped in a protective envelope.
FIG. 4 is a cross sectional view taken along line 4—4 of FIG. 1.
FIG. 5 is a cross sectional view taken along line 5—5 of FIG. 1

An illustrative embodiment of the present invention will next be provided, with reference to the accompanying drawings.

DESCRIPTION OF A PREFERRED EMBODIMENT

Illustrated in the drawings is a disposable head brush 10 for scrubbing a human torso, including the back, while bathing, along with a display card 200 for the brush. The brush comprises two major parts, the handle 20 and the head 100. In a preferred embodiment, the handle 20 is made of a rigid molded plastic such as polypropylene or polyethylene and is approximately 15 and one-half to 16 inches long. It is elongate with a first end 30 having a hook 36 or curved portion. The hook has an inner diameter of approximately one and a quarter inches so that the handle can be easily hooked over the water pipe protruding out of a wall to a shower head or on the shower curtain rod. In a preferred embodiment, the hook 36 is arcuate, however other designs such as a v-shaped notch or a flat extension with a protruding elbow is also contemplated.

At the other or second end 51 of the handle 20 is the receptacle 50. Between the hook and the receptacle is the hand-hold 40. In a preferred embodiment, the hand-hold is approximately eleven inches long and of sufficient diameter and shape that it can be easily held in the hand of a human. The hand-hold also comprises a first roughened area 32 near the receptacle and a second roughened area 34 near the hook. The roughened areas 32 and 34 act to enhance the gripability of the hand-hold by the human hand, especially when it is wet, as for instance when bathing or showering. The pair of roughened areas 32 and 34 is provided so that the hand can hold the brush in the first roughened area 32 near the receptacle 50 to scrub a major portion of the body and the hand-hold can be held in the second roughened area 34, near the hook 36 so that the receptacle 50 is remote from the hand of the user and can be used to scrub a person's back.

At the second end 51 of the handle 20, receptacle 50 comprises a proximal end 52 adjacent the hand-hold 40 and a distal end 54. The receptacle 50 further comprises a central web 56 having a first or top side 58 and second or bottom side 60. The receptacle 50 further comprises a first curved sidewall 62 and a second curved sidewall 64.

Located at the proximal end of each of the sidewalls is a first head stop 66 and a second head stop 67. Each of the stops comprises a laterally extending shoulder or land 65 at the end of the curved sidewall.

Running longitudinally along the receptacle is a pair of grooves 90 and 92. The first groove 90 forms a step or slot between the first curved sidewall 62 and the first side 58 of the central web 56. The second groove 92 forms a step or slot between the second sidewall 60 and the first side 58 of the central web 56.

In a preferred embodiment, the distal end 54 of the receptacle 50 has a protruding or outwardly extending tang 68. The tang 68 protrudes outwardly from the second side 60 of the central web 56. The tang comprises a sloping endwall 94 and a transverse stopwall 96, which intersect at a top line.

The distal end 54 of the receptacle 50 also comprises a pair of laterally extending finger recesses 70.

Also extending outwardly from the second side 60 of the central web 56 are a pair of reinforcing ribs 74. The first side 58 of the central web also comprises a flat portion 76 that can be used for placing instructions for the use of the brush or advertising for the operator of the motel or other establishment in which the brush is being used.

Immediately after manufacture, the head 100 is preferably wrapped in a clear cellophane package or envelope 102 as shown in FIG. 3. The packaging 102 should be made so that it can be tamper evident so that the user has confidence that the head 100 has been made sanitary before use. If the head is being reused, it should be hygienically cleaned prior to packaging.

The head comprises a scrubbing portion 110 which can comprise either a sponge or a brush. The scrubbing portion 110 is preferably a sallow sponge. However, other materials can be used, such as bristles, foam sponge, luffa sponge or natural sponge or any other compatible material for scrubbing one's body or scratching one's back. The scrubbing portion 110 has a first side 112 and a second side 114.

The head also comprises a backing portion 120. The backing portion is preferably made of a semi-rigid plastic such as polypropylene or polyethylene. The backing portion comprises a central connecting plate 126, a first concave sidewing 122 and a second concave sidewing 124 and a first end 144 and a second end 146. The backing portion connecting plate 126 also comprises a first side 128 in contact with the scrubbing portion and a second side 130. The wings 122 and 124 extend away from the first side 128 and the scrubbing portion 110 and create parallel longitudinal channels 136 and 138. Each wing 122 and 124 terminates in a wing tip 140 and 142.

In a preferred embodiment, the first side 112 of the scrubbing portion 110 is adhesively retained on the first side 128 of the backing portion 120. An acceptable adhesive is 3M (tm) #4475. Other adhesives or means for retaining the scrubbing portion to the backing portion are contemplated, as are making the portions by a single construction. In other embodiments, the scrubbing portion may comprise more of a brush head appearance with bristles of either fiber or plastic. In one embodiment, the bristles or sponge may be integrally made in the backing portion 120 and protrude therefrom.

In use, the handle 20 can be maintained in a motel room or nursing home room by hanging it by the hook 36 on its first end 30 over the shower head pipe or curtain rod. A set of heads 100, in their sealed wrappers 102 can be stored at the vanity or in the display card 200 to be discussed later. The guest or patient merely opens the cellophane wrapper and slides the head over the receptacle end of the handle so that the channels 136 and 138 slide over the first and second sidewalls 62 and 64 and the second side 58 of the receptacle is in registration with the head connecting plate 126. The head passes up and over the tang 68.

The wing tips 140 and 142 of the head wings 122 and 124 are adjacent and rest in the slots or grooves 90 and 92 of the first side of the receptacle 50, so that the head 100 and handle give the appearance of a unitary member. The head is positioned between the tang 68 and the head stops 66 and 67 and is held in place by having a first end 144 in contact with the transverse wall 96 of the tang 68 and a second end 146 of the connecting plate 126 contacting the shoulders or lands 65 of the first 66 and second 67 stops.

After the brush has been used, the user, or a maid or other employee of the motel or nursing home can remove the head and easily dispose of it. The head can be removed by placing one's fingers in the recesses 70 at the distal end of the receptacle and prying the central web 126 laterally away from the tang and then sliding the head over the tang 68. The head can either be disposed of since it is very inexpensive to produce, or it can be cleaned, made sanitary and reused.

Figure 6:
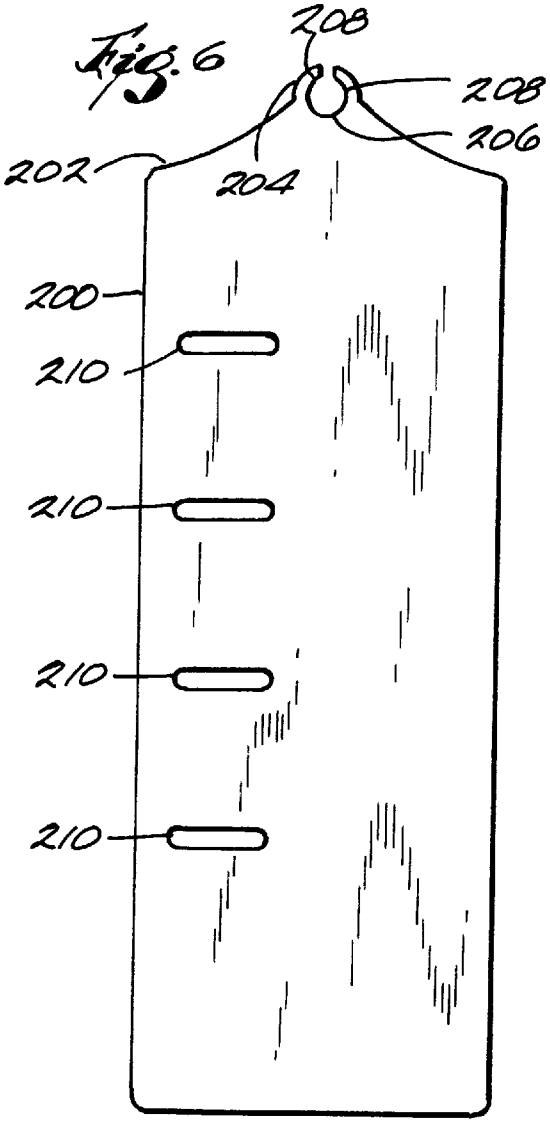
FIG. 6 is a front elevation view of a display card for the brush.

Shown in FIG. 6 is a display card 200 for holding the handle 20 and the head 100 separately prior to use. The card is flat and generally rectangular, preferably made of a sheet of plastic or cardboard. At the top end 202 of the card is a retaining means 204 for retaining the card in a hanging position from, for instance, a shower head pipe or a shower curtain rod. In one embodiment, the retaining means 204 comprises an aperture 206 with resilient arcuate side walls 208 which snap around the curtain rod.

Figure 8:
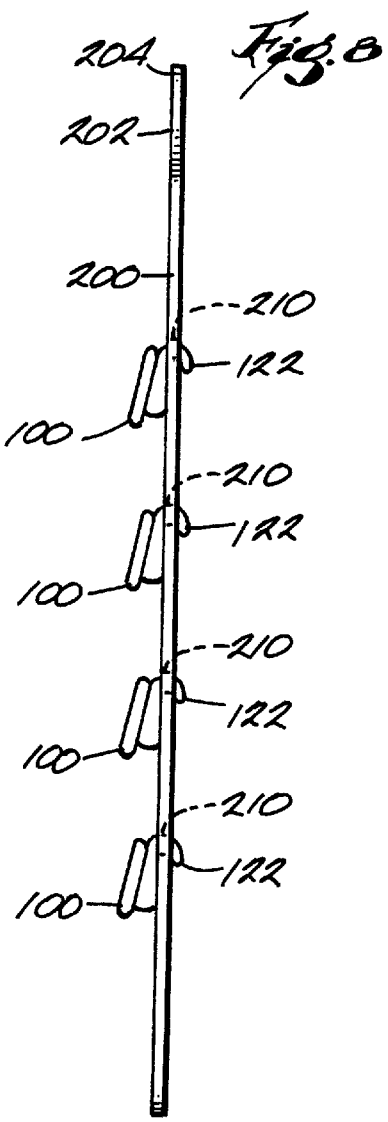
FIG. 8 is a side elevation view of a display card with a plurality disposable heads.
Figure 7:
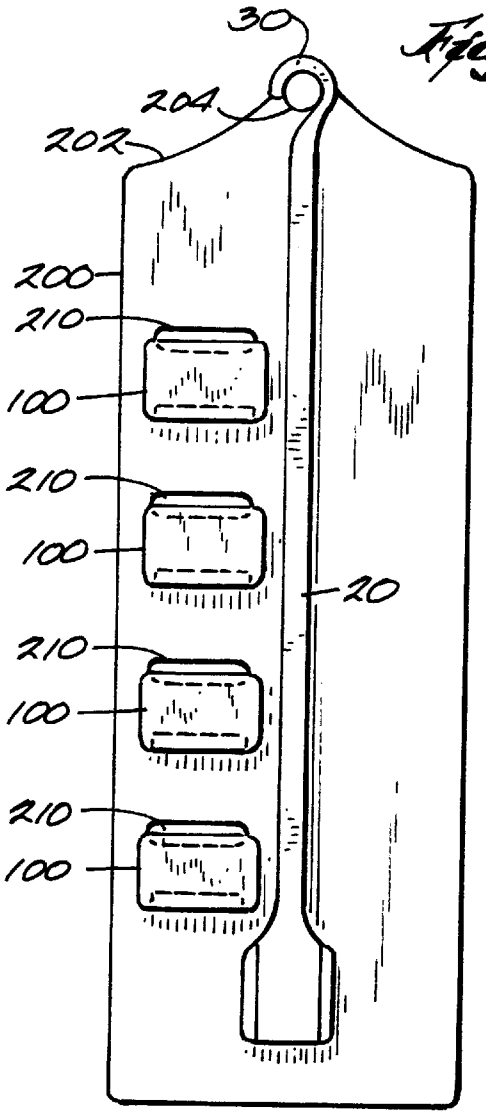
FIG. 7 is a front elevation view of a display card incorporating a brush and a plurality of disposable heads.

The card also comprises slots 210 for holding a plurality of disposable heads 100. As shown in FIGS. 7 and 8, the heads 100 are held in place by having one concave wing 122 hook onto the card 200 through the slot. The handle 20 can either be hung from the curtain rod independently, or it can be attached to the display card by complementary means, such as Velcro brand hooks and loops.

In one embodiment, the card 200 and heads 100, and optionally including the handle 20, can be hung from a wall by a suction cup attached to the wall with a hook or knob fitting through the aperture 206. In the embodiment shown in FIGS. 7 and 8, all of the heads 100 are alike. However, it can be appreciated that different types of heads 100 with different types of sponges or bristles such as natural hair bristles, or plastic bristles could be displayed for selection at the user's preference.

While the invention has been herein shown and described is what is presently conceived to be the most practical and preferred embodiment thereof, it will be apparent to those of ordinary skill in the art that many modifications may be made within the scope of the invention, which scope is to be accorded the broadest interpretation of the appended claims so as to encompass all equivalent structures and products.

What is claimed is:

1. A disposable head brush for scrubbing a human torso, including the back, while bathing comprising a handle having a hook at a first end, a receptacle at a second end and an elongated hand-hold connecting said hook and said receptacle, said receptacle having a proximal end, a distal end, a central web having a first side and a second side and a pair of laterally spaced convex curved side walls connecting said first and second sides, said curved side walls each terminating in a first head stop adjacent said proximal end, said central web having a head retaining tang protruding from said first side adjacent said distal end, and a head comprising a scrubbing portion and a backing portion, said backing portion having a pair of laterally internally concave curved depending wings and a connecting plate, said wings and connecting plate being adapted to slide over said handle central web and curved side walls and be retained by and between said head stops and tang.

2. The brush of claim 1 wherein said head scrubbing portion comprises a sponge.

3. The brush of claim 1 wherein said head scrubbing portion comprises a brush.

4. The brush of claim 1 wherein said hand-hold has roughened surfaces adjacent said first end and said second end to aid in gripping of said hand-hold by a human hand.

5. The brush of claim 1 wherein said handle hook has an inner diameter of approximately 1¼ inches.

6. The brush of claim 1 wherein the total length of said handle is approximately 15½ inches.

7. The brush of claim 1 wherein said second side of said receptacle central web is substantially flat and at least partially comprises an area for placing printed information.

8. The brush of claim 7 wherein said second side of said receptacle central web further comprises a pair of slots adjacent said curved side walls and said head curved wings have ends and said curved wing ends are located in said slots when said head is mounted on said handle.

9. The brush of claim 1 further in combination with a display card for holding said handle and said head separately before use.

10. In combination, a disposable scrubbing head and a handle, said handle comprising, a hook at a first end, a receptacle at a second end, said receptacle having a proximal end and a distal end, a central web having a first side and a second side and a pair of laterally spaced convex curved side walls connecting said first and second sides, said central web having a head retaining tang protruding from said first side adjacent said distal end and said curved side walls having head stops adjacent said proximal end, and an elongated hand-hold between said hook and said receptacle, said hand-hold having roughened surfaces adjacent said first and second ends to aid in gripping thereof by a human hand on said roughened surfaces, and said scrubbing head comprising a sponge portion having a first side and a second side and a backing portion having a central connecting plate having a first side and a second side, said first side of said sponge portion and said first side of said connecting plate being adhesively bonded, said backing portion central plate having concave arcuate side wings extending away from said first side along two opposite sides of said connecting plate whereby said head can be releasably attached to said handle by sliding said head over said receptacle with said arcuate wings wrapped around said handle curved side walls and said central connecting plate rides up and over said tang until said head is fully installed and wherein said head is retained on said receptacle by said stops and tang on two opposite ends of said central connecting plate.

11. The combination of claim 10 wherein said second side of said receptacle central web further comprises a pair of slots adjacent said curved side walls and said head curved wings have ends and said curved wing ends are located in said slots when said head is mounted on said handle.

12. The combination of claim 11 further in combination with a display card for holding said head and said handle separately before use.

* * * * *